US005547318A

United States Patent [19]

Decker

[11] Patent Number: 5,547,318

[45] Date of Patent: Aug. 20, 1996

[54] PROCESS FOR EFFECTING SEALED SHEET PILE CONSTRUCTION AND DEVICE FOR APPLICATION OF THE SEALANT RESULTING IN AN IMPERMEABLE SEALED SHEET PILE CONSTRUCTION

[75] Inventor: Jean Decker, Luxembourg, Luxembourg

[73] Assignee: ProfilARBED S.A., Luxembourg, Luxembourg

[21] Appl. No.: 208,742

[22] Filed: Mar. 9, 1994

[30] Foreign Application Priority Data

Aug. 27, 1993 [LU] Luxembourg ..... 88397

[51] Int. Cl.[6] ..... E02D 5/02

[52] U.S. Cl. ..... 405/303; 405/274; 405/279; 277/1; 277/72 FM; 425/578

[58] Field of Search ..... 405/279, 232, 405/274, 278, 303; 277/1.172 FM; 425/114; 118/317; 156/509, 578, 575, 293, 157, 304.5, 391, 579

[56] References Cited

U.S. PATENT DOCUMENTS

| | | | |
|---|---|---|---|
| 3,019,938 | 2/1962 | Miller et al. | 118/317 X |
| 3,302,412 | 2/1967 | Hunsucker | 405/279 X |
| 3,828,563 | 8/1974 | Saucke | 405/279 |
| 4,617,073 | 10/1986 | Scott | 156/579 X |
| 4,772,031 | 9/1988 | Poppo | 277/1 |
| 4,902,171 | 2/1990 | Geffriaud et al. | 405/232 |

FOREIGN PATENT DOCUMENTS

| | | | |
|---|---|---|---|
| 0286068 | 10/1988 | European Pat. Off. | 405/279 |
| 2722978 | 11/1978 | Germany . | |

*Primary Examiner*—Dennis L. Taylor
*Attorney, Agent, or Firm*—Fishman, Dionne & Cantor

[57] ABSTRACT

A process is presented for effecting sealed sheet pile constructions in which at least one of the sheet pile interlocks of a pair of sheet pile interlocks is filled with a sealing compound by moving a feeding chamber in an axial and concentric manner along the interlock. In addition, a device for carrying out the aforementioned process is presented comprising a central feeding chamber provided with a dorsal entrance bore, a longitudinal sliding guide block and a sealing compound distributing chuck. The section of the sliding guide block is identical to, but slightly narrower than that of the sheet pile interlock chamber.

14 Claims, 1 Drawing Sheet

PROCESS FOR EFFECTING SEALED SHEET PILE CONSTRUCTION AND DEVICE FOR APPLICATION OF THE SEALANT RESULTING IN AN IMPERMEABLE SEALED SHEET PILE CONSTRUCTION

BACKGROUND OF THE INVENTION

This invention relates generally to sheet pile constructions. More particularly, this invention relates to a process for effecting sealed sheet pile constructions and a device for application of a sealant to assure an impermeable sealed sheet pile construction.

Metallic sheet pile assemblies must, in a great many cases, be impervious to water, other liquids or to products dissolved or suspended in such fluids as well as such gases as are for instance, generated within dumping grounds. There is a particular need for an economical process for rendering sheet pile assemblies impervious to liquids and gases and a device for applying sealants into the interlocks of sheet piles that assures proper spread and distribution of the sealant.

It is well known in the art that the edges of sheet piles have an overall shape which either shows a flat web or has a U-shaped or a Z-shaped section fabricated, in such a manner, that one sheet pile may be connected to another contiguous sheet pile. These shaped edges, called interlocks, are inserted by sliding or by threading one interlock into the other or mating interlock. Whatever the specific configurations and particular names of the known interlocks, after assembly of a particular set of two sheet piles, one to the other, there results a certain amount of play within the set of interlocks. This inner play on the one hand permits the sliding or threading of the individual interlocks into one another without seizing up. On the other hand, the resulting assembly is left with a large amount of flexibility and mobility.

It is relatively easy to render such interlocks tight and impervious when such sheet piles are assembled together at the plant in units of two or three sheet piles. However, it is not possible to treat such interlock joints once the interlock joints have penetrated into the soil or any other below ground situation by sliding one interlock within the other interlock of a pair of interlocks since the interlocks are no longer accessible. Now there are all kinds of construction sites that do not allow impervious sealing of the interlock joints of sheet piles in the field. Particularly difficult are waterside construction sites. Even more difficult challenges are the containment of dumping grounds and slag tips. It is obvious that a more effective and permanently tight seal is required.

One of the known methods to provide tight and impervious sheet pile assemblies has been disclosed in the German Patent DE-PS-27-22-978. In accordance with this prior art method, a product of a fluid or plastic consistency is applied under pressure onto the bottom surface of the interlock in such a way that this product sticks to the interlock bottom as a result of the action of the pressure. The still malleable bead thus deposited into the interlock is then spread and shaped with the aid of a kind of "scraper blade". This "scraper blade" confers to the bead the desired shape on the preselected wall part of the sheet pile before the product hardens by polymerization. This operation must be completed quickly so that the product remains elastic for the next operation. The interlock so treated is inserted or drawn into a non-treated interlock which has already been driven into the soil or ground.

There are several problems associated with this prior art method. In the first place the use of the recommended sealing compounds presupposes that the bottom of the interlock is perfectly clean. In addition, it requires that the interlock has been rendered free of mill scale by sandblasting and that the interlock was thereafter painted with a primary coating so that the product will stick where the product has been deposited so that the seal may be shaped as hereinabove described. These steps, are as a rule, carried out manually and successively. Even if, in accordance with this prior art patent, only every second interlock is treated for each sheet pile, or double or even triple sheet pile unit belonging to a sheet pile assembly, it is obvious that these sheet pile assemblies each have to be treated individually. The aforementioned treatment requires successive operations. This results in a slow, tedious and expensive process.

There are several additional drawbacks to the elastic tightness and impervious seal as provided in the prior art patent. Firstly, the shape of the elastic seal may not be very uniform if the deposited bead contains too much or too little sealant. Secondly, it is difficult to maintain a straight seal as a result of the smoothing operation. Thirdly, it appears that it is almost impossible to apply the sealant in the forward acute angle corner of the Larssen interlocks with the manual tool as taught in the prior art patent.

However, the biggest drawback of the aforementioned prior art elastomeric product seals is that the thus treated sheet piles cannot be driven into the soil or ground with assurance that the interlocks will remain impervious to liquids and gases when the sheet piles are driven by a vibratory pile driver. The vibratory pile driver causes less nuisance and problems and is therefore often preferred to ram hammers. Indeed, the seal fissures and becomes detached and damaged due to the high temperature and friction caused by the vibratory pile driver or like device. The detached part of the seal rolls up and accumulates at the top of the interlock of the already driven sheet pile. The excess material clogs up and eliminates the play between the two interlocks. This excess material causes scraping and crumbling over what is often a very important and critical distance. It is obvious that as a result of such damage, the seal, if indeed there is even some of the seal left, no longer retains the required imperviousness.

From the foregoing discussion, it can be seen that there is a need for a process for rendering tight sheet pile constructions that is simple, easy and inexpensive to use which results in a seal that is not subject to damage and achieves optimal tightness over the entire length and surface of the interlock in contrast to the prior art.

SUMMARY OF THE INVENTIONS

The above-discussed and other problems and deficiencies of the prior art are overcome or alleviated by the process for effecting sealed sheet pile constructions and device for application of the sealant resulting in an impermeable sealed sheet pile construction. In accordance with the present invention, an efficient low cost interlock seal which results in tight sheet pile constructions is effected with a novel device for application of the sealant. The resultant seal is extremely resistant to damage and provides optimal tightness over the entire length and surface of the interlock thus treated.

The interconnection between two mating interlocks of two sheet piles, prior to the threading or engagement, is completely filled with a sealing compound. This filling can be done to either one or both interlocks of a pair of mating interlocks. The sealing compound is of a plastic or pasty consistency and is contained within the feeding area extending from the bottom of the interlock up to the upper rim of the feeding chamber by the geometry of the device in accordance with this invention. While the device is moving the feeding area from one end of the interlock to the other end of the interlock, the compound filling the whole volume of the interlock is flowing out along the faces of a profiled chuck which is moved at the same time as the feeding area, while the axis of the device is kept concentric with respect to the axis of the cavity of the interlock.

The device to implement the process for effecting sealed sheet pile constructions in accordance with the present invention is comprised as follows. The device has a central chamber. The central chamber is provided with a dorsal entrance communicating with a reservoir of sealing compound and a longitudinal forward sliding block having a section which is identical to but slightly narrower than that section of the chamber of the interlock through which the forward sliding block can be freely moved. The backward face of the longitudinal forward sliding block constitutes the forward wall of the central feeding chamber. The rear wall of the central feeding chamber is formed by the front face of a terminal chuck which follows the central feeding chamber. The terminal chuck follows the feeding chamber and consists of a fitting piece located concentrically with respect to the interlock chamber. The geometry of this fitting piece is a function of the configuration that is desired to be conferred to the sealing compound flowing out along the chuck. This sealing compound, after having first filled out the whole section of the feeding chamber, remains stuck to the Walls of the interlock in the form of a coating after the passage of the shaped chuck. It should be noted that the aforementioned section of the feeding chamber, delimited by the device, coincides perfectly with the interior of the sheet pile interlock. This coating, once hardened out, acts like a form of a lining which is continuous in both the longitudinal and the transversal directions.

It will be understood that the elements constituting the device, namely the front sliding block, the feeding chamber for the sealing compound and the chuck allowing the sealing compound to freely flow out can be shaped out of any combination of a single piece of suitable metal or plastic or of course any suitable combination. Moreover, the surfaces may be specially treated and finished so that the functional parts of the device can be moved through the interlock so as to minimize snags, jams and wetting with the sealing compound. This invention has a multifunctional self-centering device that is guided against the inner wall of an interlock of a sheet pile which spreads a sealing coating in just one single pass. There are known ways and means available to carry out the automatic translation movement of the device through the interlock of the sheet pile.

The seal resulting from the method and device of this invention has the following attribute. This seal, seen in the transverse direction, covers as a continuous coating the most important part of the inner surface of at least one interlock out of a pair of interlocks. This invention provides devices for the three most used interlocks known for sheet piles and allows the inner faces of these interlocks to be coated over the entire length of the particular interlock channel. Of course this device could be adapted for any other interlock.

Depending upon the particular embodiment of this invention, the resulting hardened lining of the seal coating will show parts with a modulated thickness. This thickness will vary according to the requirements of the particular interlock. For example, a particular type of interlock would require a thicker seal at the bottom surface of the interlock. In the case of the Larssen sheet pile interlock, the section of the seal that covers the hidden corner with its acute angle would have a thicker cross-section than the rest of the Larssen sheet pile interlock. It will be sufficient in many cases to treat just one of the interlocks constituting a pair of threaded interlocks. However, it is also possible to treat the chambers of the two interlocks out of a pair of interlocks, in which case the linings are usually of an equal but lesser thickness, except maybe in the acute angle corners as previously discussed. This work is generally done with automated equipment either in a plant or at the job site.

Some of the advantage of the method and device of the present invention over the prior art methods is as follows. Depending on the kind of sealing products selected, expensive, tedious and time consuming methods for preparation of sheet pile interlocks for sealing are eliminated. These methods include sandblasting, time consuming drying and painting with a primary coating material or arrangement of the sheet piles in a flat or horizontal position within a special treatment stand. The treatment in accordance with the present invention is simple, rapid and economical to operate. The preferred compound may, as a rule be selected among the known compound materials, which, after having been applied, either retain a sufficient elasticity, or are hydroswelling.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
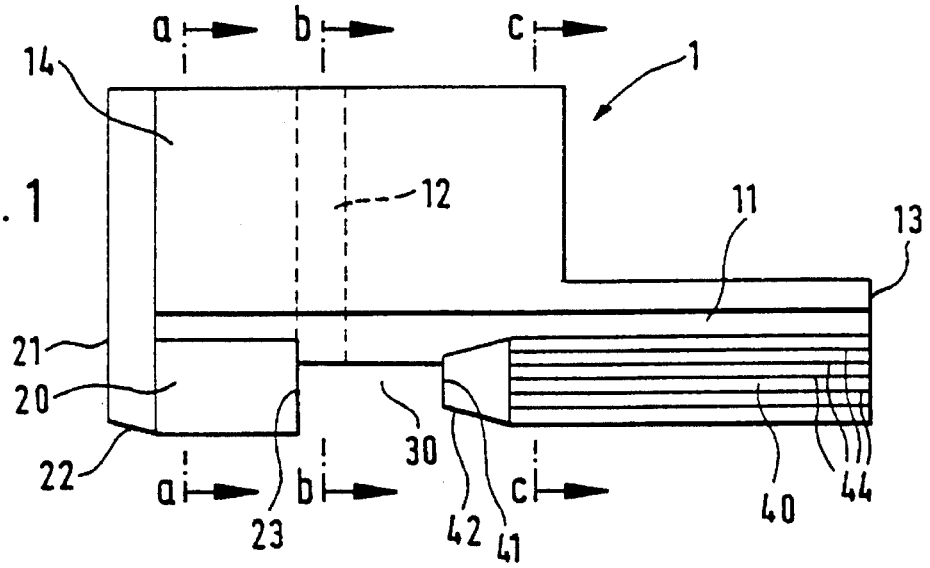
FIG. 1 is a side elevation view of a device for application of sealant resulting in an impermeable sealed sheet pile construction in accordance with the present invention.

Referring first to FIG. 1, the device for application of the sealant resulting in an impermeable sealed sheet pile construction is generally shown at 1. Device 1 is comprised of three main functional elements including a sliding block 20, a feeding chamber 30 and a sealing compound distributing chuck 40.

Figure 2A:
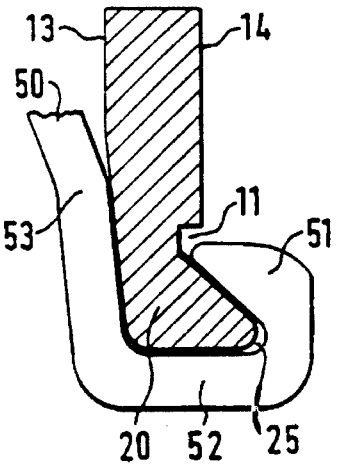
FIG. 2*a* is a transverse sectional view along the line a—a of FIG. 1, each transverse section through a sheet pile interlock showing the relative position of the present invention within a sheet pile interlock.

Referring now to FIG. 2*a*,it is seen that the section of the sliding block 20 has exactly the identical shape of the Larssen interlock 50 except of course, the dimensions of sliding block 20 are slightly smaller so as to leave a clearance 25. The front face 21 (see FIG. 1 ) of the sliding block 20 preferably has a taper 22 which avoids hooking or snagging during the travel of device 1 (and of course sliding block 20) within the interlock 50. The interlock 50, as a rule, does not need to be first cleaned if the interlock 50 is in the rolled condition. A minimal reduction of the cross-section of 5 mm, more or less, for the various dimensions is sufficient for the sliding block 20 to complete its linear movement through the interlock 50 and yet not allow the sealing compound to flow out in the forward direction. This is true in spite of the fact that the sealing compound is contained under a slight overpressure in the feeding chamber 30.

Figure 2B:
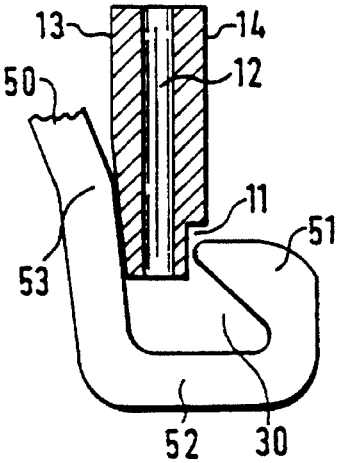
FIG. 2*b* is a transverse sectional view along the line b—b of FIG. 1, each transverse section through a sheet pile interlock showing the relative position of the present invention within a sheet pile interlock.

The sliding block 20, the feeding chamber 30 and the distributing chuck 40 (see FIG. 2*b*) show on the side of the thickened fold 51 of the interlock 50 of a sheet pile, a step 11 which overhangs the upper face of interlock fold 51. This aforementioned step 11 prevents outflow of the sealing compound in the upward direction, i.e. towards the exterior where of course, the deposit of the sealing compound would be absolutely of no use. The back face 13 of the device 1 is smooth so that sliding the device 1 along the exterior surface of the wall of the flange 53 of the interlock 50 of a sheet pile which protracts the interlock 50 and whose flange wall 53 is also smooth and in contact with back face 13. Thus, there is no leakage of sealing compound between the back face 13 of the device 1 and the flange 53 of the interlock 50 of a sheet pile.

Figure 2C:
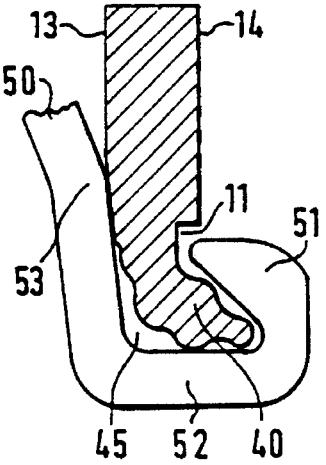
FIG. 2*c* is a transverse sectional view along the line c—c of FIG. 1, each transverse section through a sheet pile interlock showing the relative position of the present invention within a sheet pile interlock.
Figure 3:
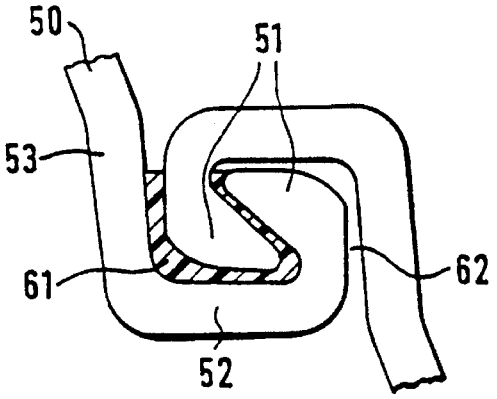
FIG. 3 is a sectional view of two interconnected interlocks of the Larssen type rendered tight by treatment of one single interlock of a pair of interlocks in accordance with the process for effecting sealed sheet pile constructions and device for application of the sealant resulting in an impermeable sealed sheet pile construction of the present invention.

It will be appreciated that for a sheet pile interlock and sheet pile of any other configuration that is different from the one illustrated in FIGS. 1–3, the shape of device 1 would be altered to conform with the respective sheet pile interlock and sheet pile. Front face 14 will be shaped to guide and retain the sealing compound and, conferred to the back face 13, will be a shape adapted to a desired sheet pile type and interlock. It should be noted that such a device in accordance with the present invention does not need a special centering feature during the device's forward movement through a sheet pile interlock.

The feeding chamber 30, (see FIGS. 1 and 2*b*) is delimited on its front side, i.e. the side lying in the travel direction of device 1, by the flat vertical back face 23 of the sliding block 20. The port 12 opens into the chamber 30 in order to maintain chamber 30 completely filled with sealing compound of a pasty to plastic consistency. Depending on the amount of sealing compound required to maintain a consistently filled chamber 30 there are several possibilities. The two most common methods are either a reservoir for the sealing compound or a feeding line which is moved together with the translation carriage (not shown) of device 1. At the top of chamber 30, device 1 shows a completely empty hollow space, which corresponds to chamber 30 of the interlock and which remains closed in the upward direction by the device 1 wall defined by the passage bore 12 for injection of the sealing compound.

The feeding chamber 30 ends near the front of the sealing compound distributing chuck 40 (see FIGS. 1 and 2*c*). FIG. 2*c* shows the profile 44 which has been selected as a function of the shape and extent of the layer of the sealing compound coating with which it is intended to cover the inner surfaces of an interlock. This is the reason why the gap 45 between face 44 of the sealing compound distributing chuck 40 and the inside interlock 50 surfaces determine the profile of the seal coating and of the lining resulting from the operation.

Sealing compound distributing chuck 40 is preferably longer than sliding block 20. This is especially the case if the distributing chuck 40 is hollow and if the distributing chuck 40 is used to convey a fluid (either a gas or liquid). In this case, the fluid flows out towards the exterior of the distributing chuck through minute lateral tuyeres so as to act on the coating entering into contact with the inner surface of the sheet pile interlock chamber within chamber 30 of device 1. In this manner a gas can be used to render the sealing coating corrugated, whereas a liquid can be used, for example, to accelerate the polymerization or to retard the hydroswelling reactions.

It is to be understood, that in accordance with the present invention, device 1 is easily adapted to the various profiles and to the varying dimensions of the sheet pile interlocks to be treated. In actual practice, the part of device 1 that must be altered for an interlock of a sheet other than the one that the device 1 is designed for can be made of a single machined piece of 10 to 20 cm by 5 to 10 cm and a maximum thickness of less than 5 cm. Also it should be noted that instead of machining entire pieces, it is also possible to render interchangeable the individual parts of device 1. This would be the step 11 covering the hollow chamber of the interlock, the sliding block 20 and the sealing compound distributing chuck 40.

Referring now to FIG. 3, a single sealing lining 61 covering the inner walls of the left interlock only is shown. Depending on the application of the sheet pile construction, it is quite possible to treat the two interlocks as well as the single interlock shown. In that case, the gap 62 would also be filled out by a lining identical to the lining 61. It can be seen that the coating is liable to be of substantially greater thickness in the straight angle corner, i.e. between the parts 53 and 52. The same condition exists in the acute angle recess between the parts 52 and 51 located beneath the fold 51 of the interlock 50. It should be noted that tightness seals applied even in a workmanship manner in accordance with known prior art methods would not result in a satisfactory seal in the area of the aforementioned acute angle recess.

In sharp contrast, in accordance with the present invention, there is no problem in modulating or changing the profile of the seal coatings to give adequate varying coatings to cover all of the portions of the interlock walls including the acute angles of the parts 51 and 52. The seal coating is normally thin on the flat surfaces of the interlock in contrast to the thicker coatings in such places as the acute angles between the parts 51 and 52. In accordance with the present invention, the seal coating will not be pushed out of the interlock or damaged when the two interlocks are threaded one into the other. To the contrary, the seal coating will remain in its correct position all over the section of the interlock and over the entire length of the sheet pile. This is a big difference over the prior art where under the prior art, the seal coatings tended to either break, scrap or crumble easily.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Process for effecting sealed sheet pile constructions prior to threading wherein at least one interlock of a pair of interlocks is, over a given distance of its length, completely filled with a sealing compound and wherein the sealing compound is contained within a feeding chamber area extending from the bottom of the interlock up to the upper rim of the interlock, including the steps of:

moving said feeding chamber area from one end of the interlock to the other end of the interlock;

moving a profiled sealing compound distributing chuck axially at the same time as the feeding chamber is moved while maintaining the axis of the profiled sealing compound distributing chuck concentric with respect to the axis of the cavity interlock to thereby fill with sealing compound the whole volume of the interlock section flowing out along the faces of the profiled sealing compound distributing chuck.

2. A sealing compound application device comprising:

a central feeding chamber provided with a dorsal entrance bore communicating with a reservoir or other means for supplying the sealing compound;

a longitudinal forward sliding guide block having a section which is substantially identical to, but narrower than that section of the interlock chamber through which the forward sliding guide block can be freely moved wherein the forward sliding guide block has a back face which defines the front wall of the central feeding chamber;

a sealing compound distributing chuck having a front wall which forms the rear wall of the central feeding chamber, and follows the central sealing compound feeding chamber, the cross-section of the sealing compound distributing chuck being smaller than the cross-section of the forward sliding guide block.

3. The device of claim 2 wherein the sealing compound distributing chuck has a fitting piece concentric with respect to the interlock chamber, the fitting piece having a section selected as a function of the configuration to be conferred to the sealing compound flowing out along the walls of the sealing compound distributing chuck and wherein the sealing compound remains stuck to the interlock walls.

4. The device of claim 2 wherein the forward sliding guide block, the central feeding chamber and the sealing compound distributing chuck are overlapped by at least one step or overhang which is in close contact with or caps the exterior interlock parts to prevent leakage of the sealing compound in the upward direction.

5. The device of claim 2 wherein the forward sliding guide block, the central feeding chamber, the sealing compound distributing chuck and a portion delimiting the step or overhang is formed from a preselected number of individual pieces adapted to the profiles and dimensions of the various sheet pile interlocks and assembled to the respective needs of the various sheet pile interlocks.

6. The device of claim 2 wherein the device is mounted on a translation carriage adapted for use in conjunction with sheet pile interlock treatment.

7. The seal resulting from the process of claim 1 wherein the resultant seal covers at least a portion of the inner chamber surface of at least one sheet pile interlock of a pair of sheet pile interlocks.

8. The seal of claim 7 wherein the seal lining covers all the inner faces of a sheet pile interlock.

9. The seal of claim 7 wherein the seal lining, in cross-section, has a modulated thickness with respect to an inner contour of the sheet pile interlock.

10. A method for applying a seal to the interlock member of a sheet pile prior to effecting an interlock between two sheet pilings, including the steps of:

moving an applicator device within and along the length of an interlock member;

defining within said applicator device a feeding chamber for the introduction of sealant, said feeding chamber having a length less than the length of said interlock member and being moveable along the length of said interlock member;

supplying sealant to said sealing chamber to substantially fill said feeding chamber with sealant; and moving a contoured distributing chuck through said sealant to form a contoured seal along the surface of said interlock conforming to the shape of said interlock member, said distributing chuck being attached to said applicator device and moving with said applicator device.

11. An sealing compound applicator device for applying a sealant to an interlock section of a sheet pile, the device including:

a sliding block having a cross-sectional shape corresponding to but narrower than a section of the sheet pile interlock to which the sealant is to be applied, said sliding block being at the front of the application device;

a feeding chamber for depositing sealant in the interlock section, said feeding chamber being located behind said sliding block;

supply means for delivering sealant to said feeding chamber; and a distribution chuck behind said feeding chamber, the cross-section of said distribution chuck being smaller than the cross-section of said sliding block and being contoured in accordance with the shape of said interlock section to form a sealing layer in said interlock section.

12. The device of claim 11 wherein:

the rear surface of said sliding block and the front surface of said distribution chuck define the length of said feeding chamber.

13. The device of claim 12, including:

an overhang section to prevent leakage of sealant during the course of application of the sealant to the interlock section of a sheet pile.

14. The device of claim 13, wherein:

said overhang section extends along substantially the entire length of said sliding block, said feeding chamber and said distribution chuck.

* * * * *